US007044414B1

(12) United States Patent
McQuerry

(10) Patent No.: US 7,044,414 B1
(45) Date of Patent: May 16, 2006

(54) WIRE DISPENSING ASSEMBLY

(76) Inventor: Richard Wayne McQuerry, 9319 Perryville Rd., Danville, KY (US) 40422

( * ) Notice: Subject to any disclaimer, the term of this patent is extended or adjusted under 35 U.S.C. 154(b) by 105 days.

(21) Appl. No.: 10/685,279

(22) Filed: Oct. 14, 2003

Related U.S. Application Data

(60) Provisional application No. 60/420,576, filed on Oct. 24, 2002.

(51) Int. Cl.
*B65H 75/40* (2006.01)

(52) U.S. Cl. ..... 242/403.1; 242/129.51

(58) Field of Classification Search ..... 242/403, 242/403.1, 557, 596.3, 129.5, 129.51, 129.53, 242/130, 134, 141
See application file for complete search history.

(56) References Cited

U.S. PATENT DOCUMENTS

| | | | | |
|---|---|---|---|---|
| 461,118 | A | 10/1891 | Macy | |
| 589,490 | A | 9/1897 | Young | |
| 822,450 | A | 6/1906 | Hatcher | |
| 877,254 | A | 1/1908 | Swanson | |
| 1,230,794 | A * | 6/1917 | Schick | 242/557 |
| 1,404,672 | A | 1/1922 | Walker | |
| 1,685,007 | A | 9/1928 | Schwindenhammer | |
| 2,029,953 | A | 2/1936 | Sutilef | |
| 2,140,676 | A | 12/1938 | Hohner | |
| 2,481,224 | A * | 9/1949 | Joswick | 242/403.1 |
| 2,549,152 | A | 4/1951 | Addison | |
| 2,578,045 | A * | 12/1951 | Conrad et al. | 242/129.53 |
| 2,917,253 | A | 12/1959 | Way | |
| 3,005,600 | A | 10/1961 | Hyde | |
| 3,009,667 | A | 11/1961 | Browne | |
| 3,680,807 | A | 8/1972 | Fortson | |
| 3,820,733 | A | 6/1974 | Roederer | |
| 4,917,322 | A | 4/1990 | Combs | |
| 5,158,243 | A | 10/1992 | Sigle et al. | |
| 5,667,163 | A | 9/1997 | Sordahl | |
| 5,775,621 | A | 7/1998 | Sauber | |
| 6,527,217 | B1 * | 3/2003 | Lyons | 242/423.2 |

* cited by examiner

*Primary Examiner*—Kathy Matecki
*Assistant Examiner*—Sang Kim

(57) ABSTRACT

A device for unrolling barbed wire or other roll goods. A basic version of which having a frame consisting of two limbs 20*a* and 20*b* flexibly joined by a hand grip 21 on the narrow end and separated by a product axle 22 on the wider product end. Furthermore said limbs 20*a* and 20*b* are confined by a locking device 23 when said locking device is slid toward the wider end and friction locks against the limbs. Optional bracket members 24 and ground wheels 27 are installed to facilitate rolling the assembly across rough terrain.

1 Claim, 7 Drawing Sheets

WIRE DISPENSING ASSEMBLY

CROSS-REFERENCE TO RELATED APPLICATIONS

This application claims the benefit of Provisional patent application Ser. No. 60/420,576 filed 2002 Oct. 24.

FEDERALLY SPONSORED RESEARCH

Not Applicable

SEQUENCE LISTING OR PROGRAM

Not Applicable

BACKGROUND OF THE INVENTION

1. Field of Invention

This invention relates to dispensing spools of rolled products and more particularly dispensing rolls of tape or wire for agriculture, specifically to the unrolling of barbed wire for animal fencing.

2. Discussion of Prior Art

Since the invention of barbed wire, farmers have struggled to find an efficient means of unrolling the wire to build a fence. Many previous inventions have addressed this problem, however few are commercially available due to the inefficiency of their designs. The poor design of other wire dispensers, resulted in poor performance, high production cost or both.

The only commercially available wire dispenser in my area is marketed as the "Roll-A-Bob." I was unable to find a patent on it during my search, however it is similar to a mulch layer U.S. Pat. No. 1,341,484 dated May 25, 1920 by H. E. Starratt. Although this device is competitively priced, the design is not ergonomic and inadequate for un-level terrain.

(a) The "Roll-A-Bob" is made from ⅜" wire and has a slip ring to hold the limbs together. The wire limb is not rigid enough to allow a full roll of barbed wire to be lifted by grasping one of the side limbs. When this is attempted the limb simply bends at the slip ring and the device is permanently altered.

(b) The handle on the device is too narrow for a normal adult to pull it comfortably with both hands.

(c) The narrow handle also limits the torque control needed to keep the roll stable on un-level terrain.

(d) The handle is constructed from the same ⅜" wire and is uncomfortably small in diameter.

(e) The design does not allow adjustment for different size rolls of product.

Many farmers place a long pole through the roll and utilize a person on each side of the pole to carry the wire along as it unrolls. This procedure has many safety hazards and ergonomic flaws.

(f) It is necessity to lift the heavy roll and carry it while dispensing.

(g) This method is also unsafe in that if one person walks faster than the other does, or if the wire gets tangled, the roll could slide on the bar and injure the workers.

(h) The pole must be carried horizontally to prevent gravity from sliding the roll on the pole and thus injuring the workers. This is difficult to do on un-level terrain.

(i) Because the pole must be carried horizontally, the pole method also has space limitations. The minimum width required to unroll the barbed wire is the width of the wire plus the width of the two people carrying the pole. Many times when a fence is built or repaired in a forested area, the wire must be unrolled between two trees or other objects and the pole will not fit.

BACKGROUND OF THE INVENTION—OBJECTS AND ADVANTAGES

My invention addresses all of the above-mentioned concerns by offering an inexpensive yet highly effective means to unroll commercially available rolls of wire. Commercially available rolls of wire vary in size and shape, but all are put up in similar rolls having a hollow core.

(a) If you want to lift the roll, you can do so by grasping one of the side limbs. This is an ergonomic way to lift the roll because it keeps the roll close to your body.

(b) The handle of my invention is wide enough for an adult wearing gloves to grasp it with both hands.

(c) The wider handle of my invention allows the operator to exert more controlling torque to prevent the roll from rotating end over end on un-level terrain.

(d) The hand grip is large enough in diameter to be comfortable to the user.

(e) Due to the tapered configuration of the limbs, the locking device will accommodate variations in roll width.

(f) You simply attach my invention to the roll, while the roll lies on the ground. No lifting of the heavy roll is required.

(g) My invention attaches to the hollow core and allows one person to unroll the wire by pulling the device along the path of the fence to be built or repaired.

(h) The limbs of my assembly prevent the roll from sliding on un-level terrain.

(i) Because one person normally pulls my invention, it will fit through areas too narrow for the pole method.

Further objects and advantages of my invention will become apparent from a consideration of the drawings and ensuing description.

SUMMARY

In accordance with the present invention of a device to unroll barbed wire put up in spools, comprised of two u-shaped limbs held flexibly on the narrower handle end and pintles aligned on the opposite end by a tube of fixed length. With a semi-rigid locking device slid from the narrow handle end toward the wider roll end until the coefficient of friction locks the device and prevents the limbs from separating. The device can be used with or without permanent or removably attached ground wheels and pulled by one or more people or a mechanical conveyance. Other options allow for different limb shapes and mechanical locking devices as revealed in the drawings and ensuing description.

DRAWINGS—FIGURES

DRAWINGS—REFERENCE NUMERALS

Figure 1:
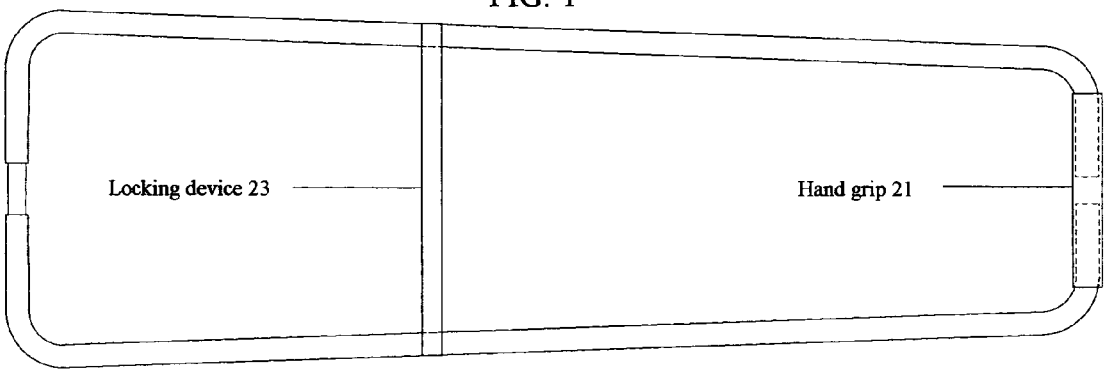
FIG. 1 is a plan view of a basic version of my invention.

20 Limb
21 Hand grip
22 Product axle
23 Locking device
24 Bracket member
25 Ground wheel axle
26 Fastener
27 Ground wheel

DETAILED DESCRIPTION—PREFERRED EMBODIMENT—FIGS. 1–6

FIGS. 1–6 show plan views of a basic version of my wire dispensing assembly. Limbs, arms or frame members 20*a* and 20*b* are flexibly connected to each other by a hand grip 21 on the narrower end. The wider end of limbs 20*a* and 20*b* are separated by a product axle 22. Locking device 23 is a band that encircles the limbs 20*a* and 20*b*, the length of said locking device is large enough to encircle the limbs but small enough to create a friction lock against said limbs as it is slid towards the wider end of said limbs. When my invention is used for dispensing rolls of barbed wire the approximate dimensions and materials are as follows:

Limbs 20*a* and 20*b* are 0.5–1.5 inch steel or aluminum tubing, 35–45 inches long with 2–7 inches bent at 85–95 degrees on each end.

Hand grip 21 is a length of flexible tubing with the inside measurement approximately equal to the outside measurement of the limbs 20*a* and 20*b*.

Product axle 22 is a length of rigid tubing a little longer than the width of the product to be dispensed. Product axle 22 has an inside diameter larger than the outside diameter of the limbs 20*a* and 20*b* or product axle 22 has an outside diameter smaller than the inside diameter of the limbs 20*a* and 20*b*.

Locking device 23 is constructed of metal such as wire or strapping or plastic such as polypropylene banding material or cord such as rope or twine. Said locking device 23 is large enough to allow the limbs 20*a* and 20*b* to be spread while the locking device 23 is positioned near the narrower hand grip 21 end and yet small enough to friction lock as it is moved toward the wider product axle 22 end.

Operation—Preferred Embodiment

FIGS. 1–6 and 15—Operation

The manner of using a basic version of my wire dispensing assembly is as follows:

Load wire into dispenser:

(a) Start with the roll of wire or other product to be dispensed lying on the ground near the area of use.

Figure 2:
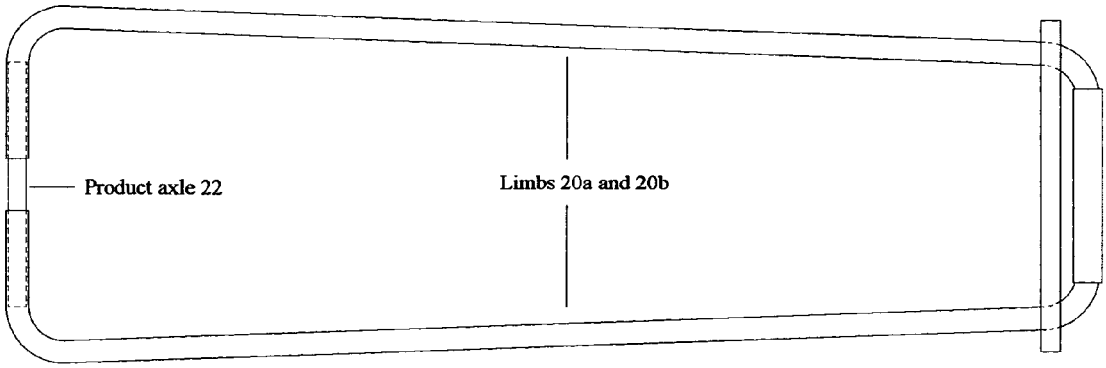
FIG. 2 is a plan view of a basic version of my invention with the limbs un-locked.

(b) FIG. 2—Move locking device 23 to narrow end of limbs 20*a* and 20*b*. This unlocks the limbs and allows them to be spread apart.

Figure 3:
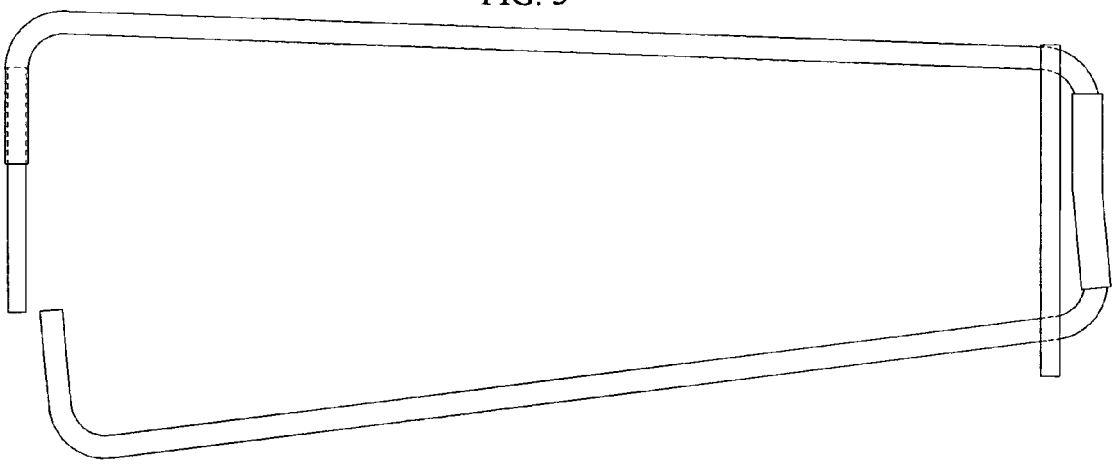
FIG. 3 is a plan view of a basic version of my invention with the limbs spread to receive a roll of wire.

(c) FIG. 3—Spread limbs 20*a* and 20*b* apart and insert product axle 22 into the core of product to be dispensed.

Figure 4:
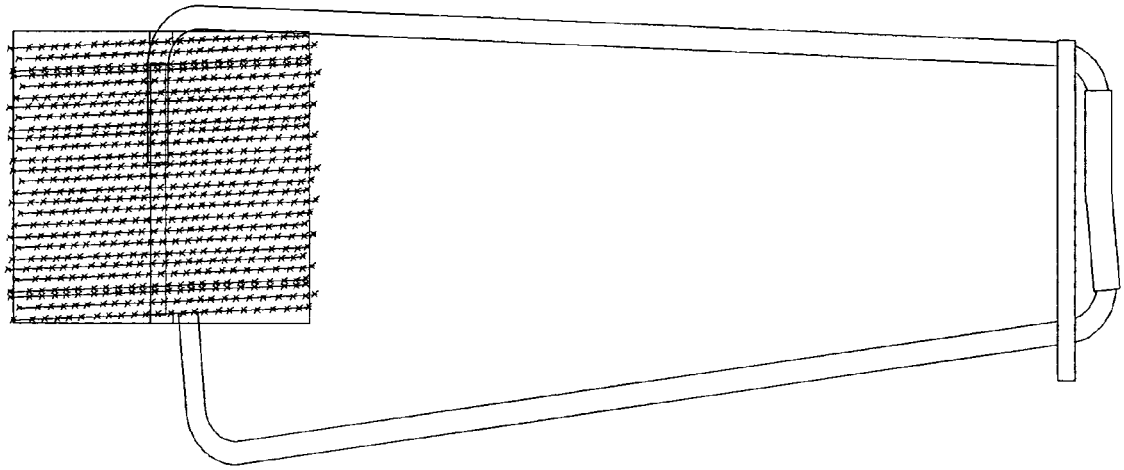
FIG. 4 is a plan view of a basic version of my invention with the roll of wire inserted.
Figure 5:
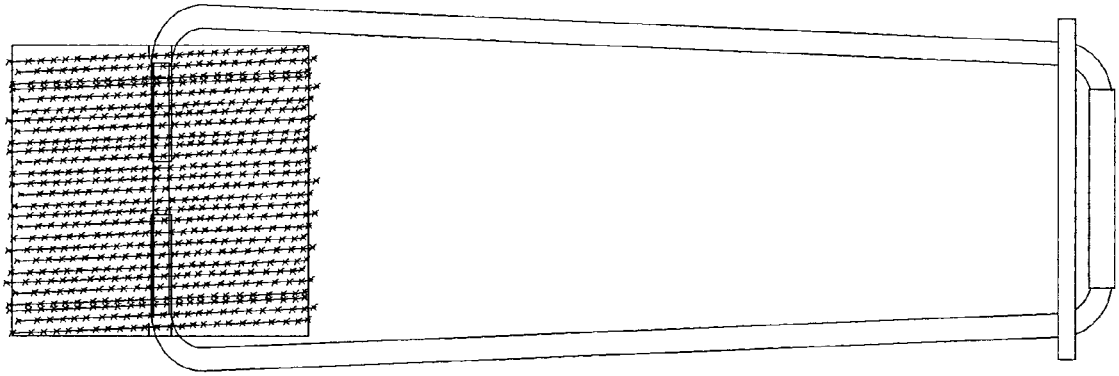
FIG. 5 is a plan view of a basic version of my invention with the limbs aligned to the product axle and closed but not locked.

(d) FIGS. 4 and 5—Return limbs 20*a* and 20*b* to their original position by aligning pintels of limbs with product axle 22.

Figure 6:
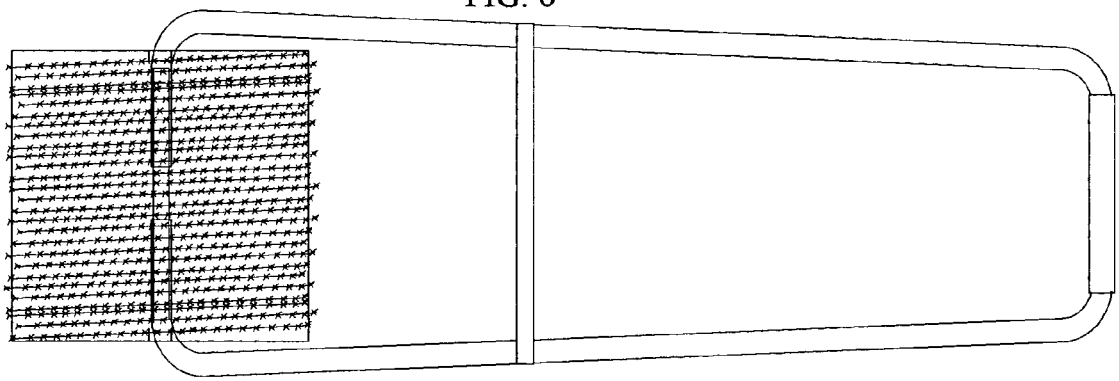
FIG. 6 is a plan view of a basic version of my invention with the roll locked into place, ready to dispense.

(e) FIG. 6—Return locking device 23 to it's original position by sliding it along limbs 20*a* and 20*b* toward the wider product axle 22 end until it friction locks.

Dispense wire.

(a) Secure loose end of wire to post, tree or other stanchion at the beginning point.

Figure 15:
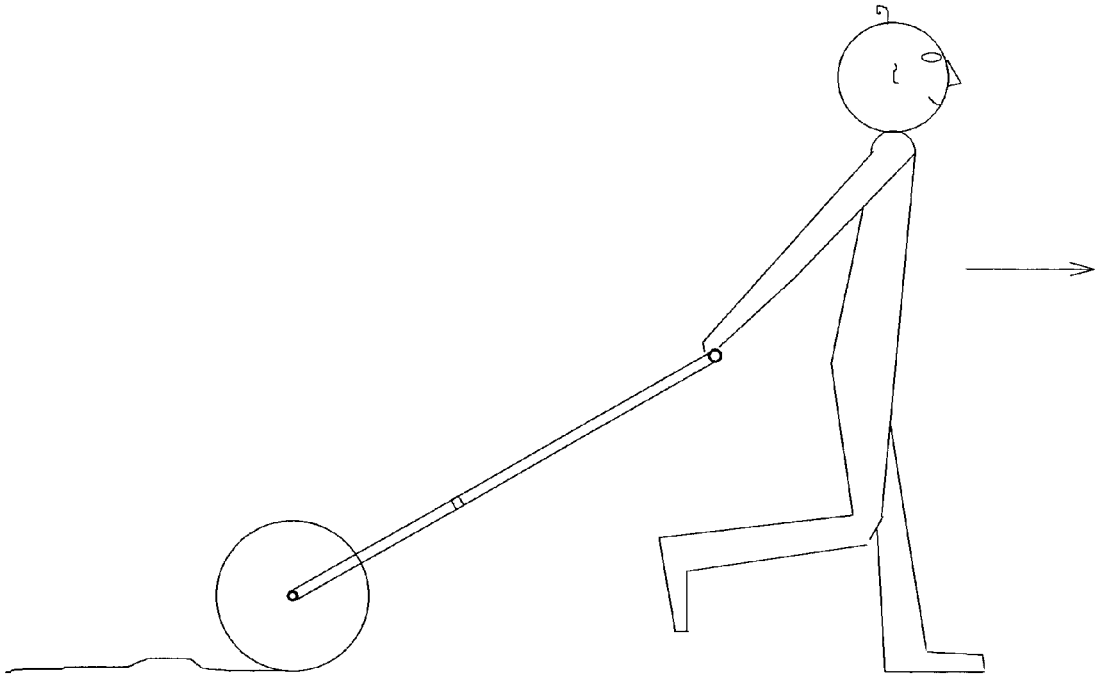
FIG. 15 is an elevation view of a basic version of my invention being used to dispense wire.

(b) FIG. 15—Grasp hand grip 21 and begin walking towards ending point of fence while allowing the product to roll in contact with the ground.

(c) Attach wire to the ending point stanchion and cut wire loose from roll.

Figure 7:
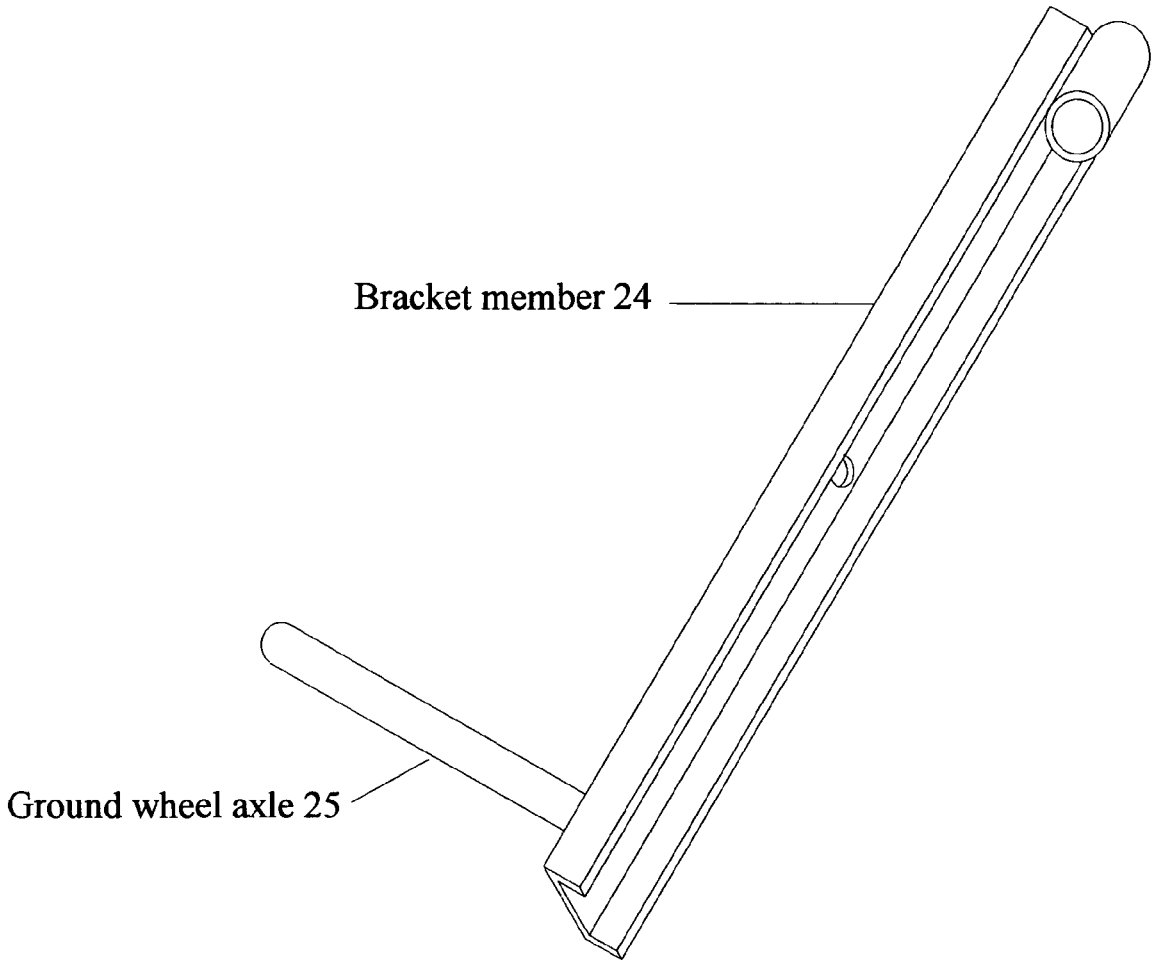
FIG. 7 is a perspective view of a basic version of a ground wheel bracket member for my invention.
Figure 8:
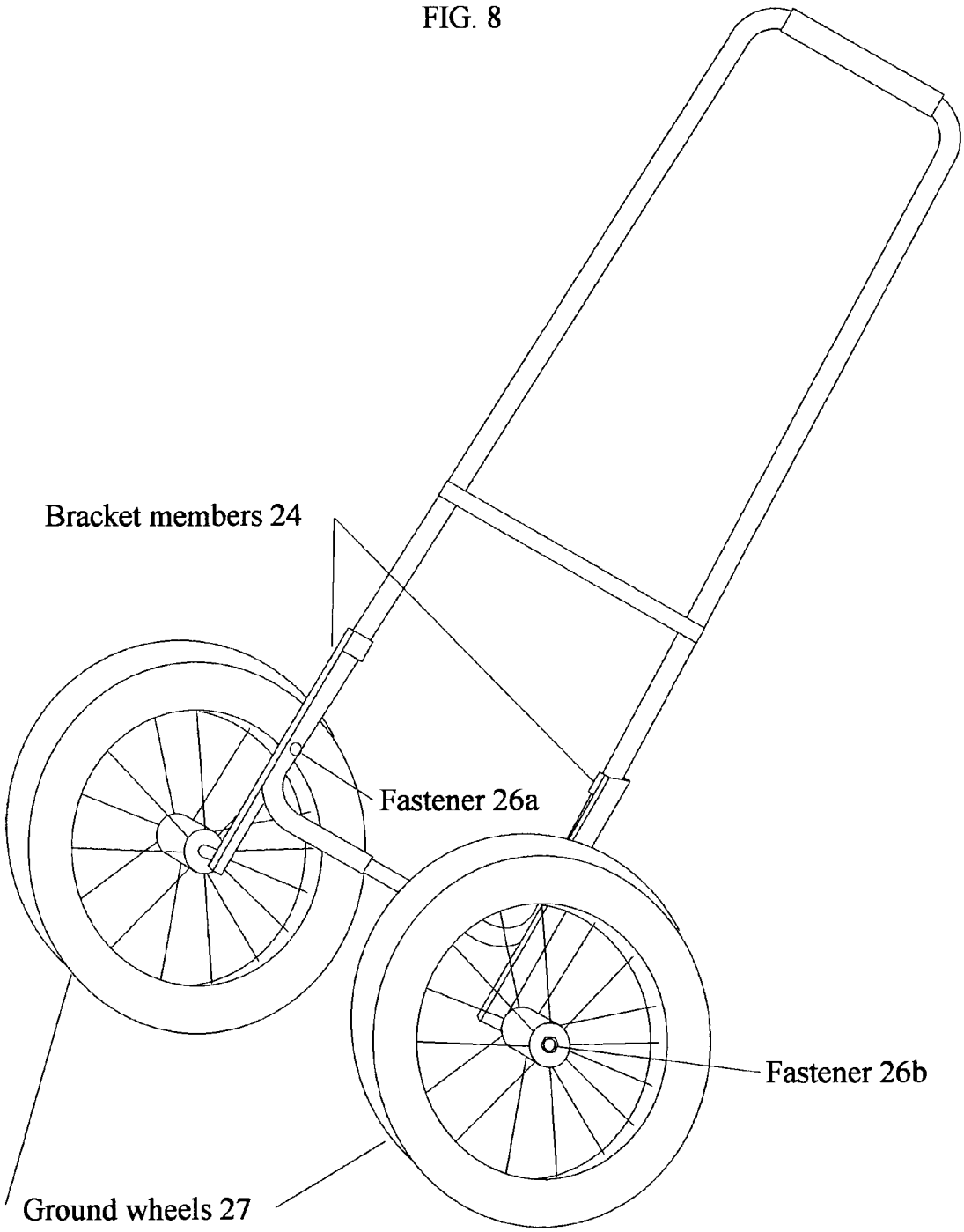
FIG. 8 is a perspective view of a basic version of my invention with the brackets members and ground wheels installed.

Description—Additional Embodiments—FIGS. 7 and 8

FIG. 7 shows a perspective view of a basic version of a bracket member 24. This version allows the bracket member to be attached with only one fastener. The length of pipe used on this basic version, spaces out the top of said bracket members 24 to align the ground wheel axles 25 and thus to align the ground wheels 27 with one another.

FIG. 8 shows a perspective view of a basic version of my wire dispensing assembly with ground wheels 27 attached, utilizing bracket members 24 and fasteners 26. Bracket member 24 is made from a length of steel or aluminum channel and a shorter length of steel or aluminum tubing. The inside dimension of the channel and tubing may be larger than the outside dimension of the limbs 20*a* and 20*b*. Ground wheel axle 25 is made from steel and placed through a hole drilled or punched into bracket member 24, or welded to said bracket member 24, or both. Fasteners 26*a* are utilized to secure bracket member 24 to limbs 20*a* and 20*b*. Fasteners 26*b* are used to secure ground wheels 27 to ground wheel axles 25.

Operation—Additional Embodiments

Same as the operation of preferred embodiments except when the product is dispensed; the product does not roll in contact with the ground. The product rolls on product axle 22 as the wire dispensing assembly is pulled along a path rolling on ground wheels 27.

Description—Alternative Embodiments—FIGS. 9–14

Figure 9:
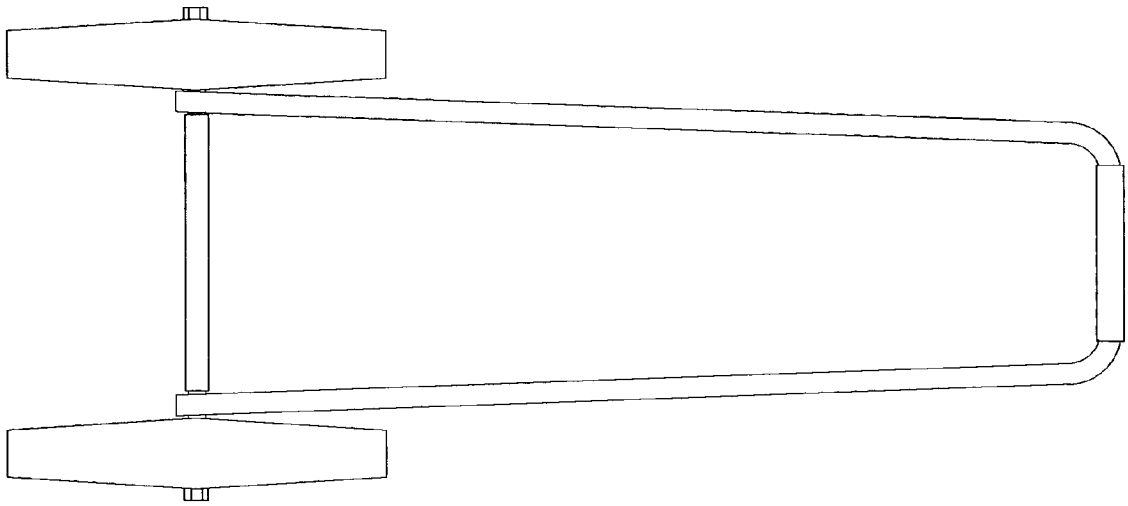
FIG. 9 is a plan view of a basic version of my invention with the ground wheels attached and an alternate locking device, which also serves as a product axle.

FIG. 9 shows a plan view of a basic version of my wire dispensing assembly utilizing a straight axle to dispense product, attach ground wheels 27 and lock the limbs 20*a* and 20*b*.

Figure 10:
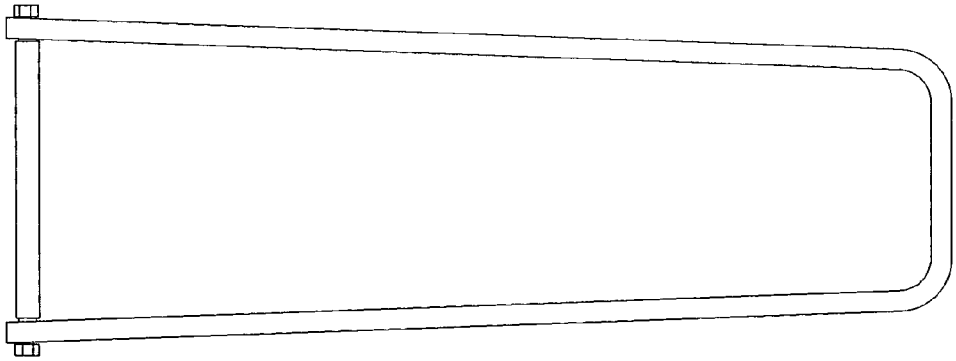
FIG. 10 is a plan view of a basic version of my invention with an alternate locking device, which also serves as a product axle.

FIG. 10 shows a plan view of a basic version of my invention utilizing a straight axle to lock the limbs 20*a* and 20*b* and serve as the product axle 22.

Figure 11:
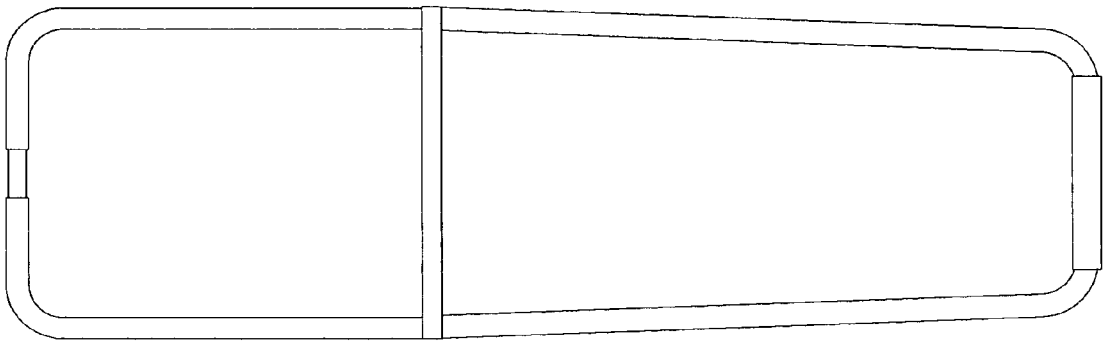
FIG. 11 is a plan view of a basic version of my invention with an alternate frame shape.
Figure 12:
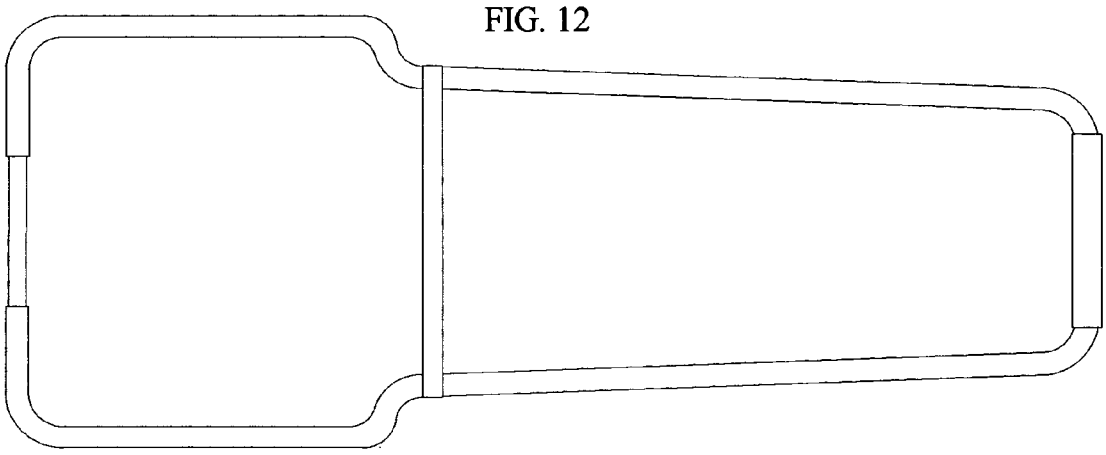
FIG. 12 is a plan view of a basic version of my invention with an alternate frame shape.

FIGS. 11 and 12 show plan views of basic versions of my invention with two of the many various possibilities of alternative limb shapes.

Figure 13:
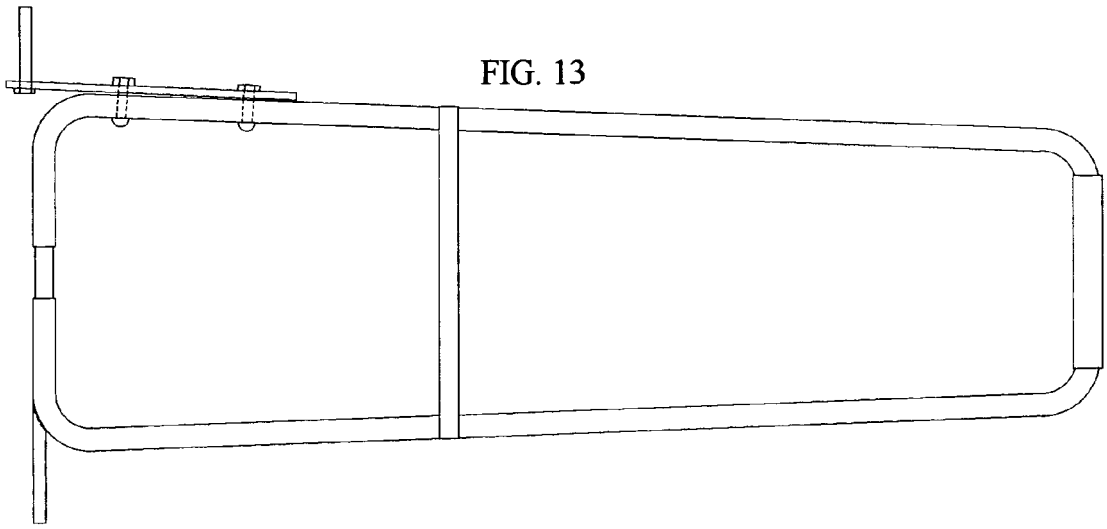
FIG. 13 is a plan view of a basic version of my invention with alternate ground wheel bracket members.

FIG. 13 shows a plan view of a basic version of my invention with an alternate bracket member 24 attached with a plurality of fasteners 26*a* and another alternate bracket member attached by welding.

Figure 14:
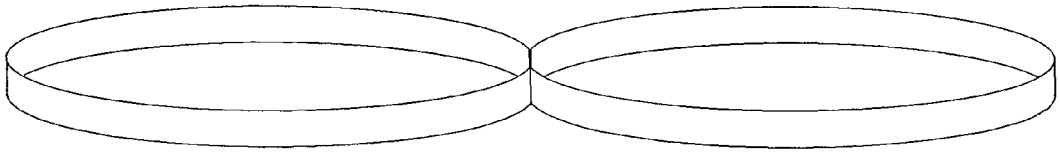
FIG. 14 is a perspective view of a basic version of an alternate locking device.

FIG. 14 shows a perspective view of a basic version of a locking device 23 with a double loop to prevent it from sliding completely off the limbs 20*a* and 20*b*.

Operation—Alternative Embodiment—FIG. 9

The manner of using a basic alternate version of my wire dispensing assembly is as follows:

Load wire into dispenser:

(a) Start with the roll of wire or other product to be dispensed lying on the ground near the area of use.

(b) Remove one fastener and one wheel from the straight axle. This unlocks the limbs 20*a* and 20*b* and allows them to be spread apart.

(c) Spread limbs 20*a* and 20*b* apart and insert straight axle into the core of product to be dispensed.

(d) Return limbs 20*a* and 20*b* to their original position by aligning the limb with the straight axle.

(e) Return wheel and fastener to its original position connecting limbs 20*a* and 20*b*.

Dispense wire.

(a) Secure loose end of wire to post, tree or other stanchion at the beginning point.

(b) FIG. 15—Grasp hand grip 21 and begin walking towards ending point of fence while allowing the product to roll in contact with the ground.

(c) Attach wire to the ending point stanchion and cut wire loose from roll.

Operation—Alternative Embodiment—FIG. 10

Same as FIG. 9 except there is no wheel to remove and re-install.

Operation—Alternative Embodiments—FIGS. 11–14

Same as operation of preferred embodiments.

Advantages

From the description above, a number of advantages of my wire dispensing assembly become evident:

(a) My invention utilizes a wider handle than the "Roll-a-bob" which allows for a two-hand grip and provides more torque control on un-level terrain. This safety feature helps protect the worker from hand, arm, shoulder and back injuries.

(b) My invention utilizes a bigger handle than the "Roll-a-bob" which provides more comfort to the operator's hands and is easier to operate with gloved hands. Note: Most fencers use thick leather gloves to protect themselves from the sharp barbs on the wire.

(c) My invention utilizes a longer and more rigid frame than the "Roll-a-bob" which helps keep the roll of sharp wire away from the worker's heels as it is dispensed.

(d) My invention utilizes a larger locking device than the "Roll-a-bob" and thus it is easier to operate with gloved hands.

(e) Due to the tapered configuration of the limbs utilized on my invention, the locking device will accommodate variations in roll width.

(f) My invention solves the problem of how to pick-up a roll of barbed wire without getting injured by using the rigid frame as a handle.

(g) My invention allows a person of limited strength to unroll barbed wire because no lifting of the roll is required. This is also a safety device that can save workers from back injuries.

(h) My invention is more economical to produce than other patented devices.

CONCLUSION, RAMIFICATIONS, AND SCOPE

Accordingly, the reader will see that my wire dispensing assembly invention is economical to produce and very efficient to use. My invention allows persons with varying degrees of strength to unroll barbed wire safely and efficiently over almost any terrain.

While my above description contains many specificities, these should not be construed as limitations on the scope of the invention, but rather as an exemplification of one preferred embodiment thereof. Many other variations are possible. For example:

(a) The invention can be used to unroll electric fence wire, plastic horse tape, electric coated wire, string, twine or any other item put up on rolls.

(b) The invention can be pulled by an all terrain vehicle, truck, tractor or beast of burden.

(c) The limbs could be many shapes and sizes and be manufactured from solid or hollow metal, plastic, wood, fiberglass or any other rigid or semi-rigid substance.

(d) The hand grip can be the flexible member attaching the limbs or a hinge or pin can be used to allow the limbs pivot or the limbs could just flex enough to allow the roll to be loaded.

(e) The locking device can be adjustable or fixed length and constructed from many different materials such as metal, plastic, string, twine, etc.

(f) The locking device can be a rigid arm that utilizes a detent to keep the limbs from separating.

(g) The locking device could slide to a notch to increase the friction while in the locked position.

(h) The product axle can be rigid or flexible and contain detents, clips, threads or fasteners to eliminate the need for a separate locking device.

(i) The product axle can be used to attach the ground wheels inside the limbs or outside the limbs.

(j) The bracket members and ground wheel axles can be removable or not and placed in line with the product axle or offset to raise or lower the roll during dispensing or loading.

Thus the scope of the invention should be determined by the appended claims and their legal equivalents, rather than by the embodiments illustrated.

I claim:

1. A dispensing assembly comprising two opposing U-shaped limbs flexibly connected at one end and detachably spaced apart at the other end by an axle of fixed length, wherein the axle is being removed to receive a roll; ground wheels attached to said axle to help transport said roll; a circular enclosure attached to said U-shaped limbs, wherein said U-shaped limbs disconnected to receive said roll; and said U-shaped limbs forming a tapered frame, wherein said frame narrower at one end and wider at the other end allowing said circular enclosure to tighten as it is positioned from the narrow end towards the wider end.

* * * * *